US008777502B2

(12) United States Patent
Shirotori

(10) Patent No.: US 8,777,502 B2
(45) Date of Patent: Jul. 15, 2014

(54) PRINTER WITH PAPER CUTTER AND CONTROL METHOD FOR THE SAME

(75) Inventor: Motoyoshi Shirotori, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 679 days.

(21) Appl. No.: 12/910,309

(22) Filed: Oct. 22, 2010

(65) Prior Publication Data

US 2011/0103869 A1 May 5, 2011

(30) Foreign Application Priority Data

Nov. 2, 2009 (JP) ..... 2009-251743

(51) Int. Cl.
*B41J 11/00* (2006.01)
*B41J 11/70* (2006.01)

(52) U.S. Cl.
USPC ..... 400/621; 400/691

(58) Field of Classification Search
USPC ..... 400/621, 691
See application file for complete search history.

(56) References Cited

U.S. PATENT DOCUMENTS

| | | | | |
|---|---|---|---|---|
| 6,508,600 | B1 * | 1/2003 | Nonaka | 400/621 |
| 7,118,208 | B2 * | 10/2006 | Nebashi et al. | 347/101 |
| 7,510,343 | B1 | 3/2009 | Arrington et al. | |
| 7,731,437 | B2 * | 6/2010 | Shirotori et al. | 400/621 |
| 2005/0123336 | A1 | 6/2005 | Oshida et al. | |
| 2005/0207818 | A1 * | 9/2005 | Tsuchiya et al. | 400/621 |
| 2007/0022858 | A1 | 2/2007 | Shirotori et al. | |
| 2009/0238631 | A1 | 9/2009 | Oshida et al. | |
| 2010/0202819 | A1 | 8/2010 | Shirotori et al. | |

FOREIGN PATENT DOCUMENTS

| | | | |
|---|---|---|---|
| JP | 11-301043 | A | 11/1999 |
| JP | 2000-052291 | A | 2/2000 |
| JP | 2001-121764 | A | 5/2001 |
| JP | 2003-311676 | A | 11/2003 |
| JP | 2005-161832 | A | 6/2005 |
| JP | 2007-038313 | A | 2/2007 |
| JP | 2009-131956 | A | 6/2009 |

* cited by examiner

*Primary Examiner* — Ren Yan
*Assistant Examiner* — Marissa Ferguson Samreth
(74) *Attorney, Agent, or Firm* — Nutter McClennen & Fish LLP

(57) ABSTRACT

A printer has an automatic cutter and a recording paper guide member. The automatic cutter includes a fixed knife attached to the printer case and a movable knife attached to an access cover. The movable knife is attached to the open side of the access cover relative to the fixed knife. The recording paper guide member is disposed to the printer case at a position closer to the open side of the access cover than the movable knife. The movable knife protruding to the fixed knife side and the recording paper guide member interfere if the access cover is opened when the movable knife has moved to the cutting start position. As a result, because movement of the access cover is limited and the access cover will not open, the movable knife protruding to the fixed knife side is not exposed outside the printer case.

6 Claims, 8 Drawing Sheets

PRINTER WITH PAPER CUTTER AND CONTROL METHOD FOR THE SAME

This application claims priority under 35 U.S.C. §119 to Japanese Patent Application No. 2009-251743 filed on Nov. 2, 2009, the entire disclosure of which is expressly incorporated by reference herein.

BACKGROUND

1. Technical Field

The present invention relates to a printer with a paper cutter of which the fixed knife is attached to the printer frame and the movable knife is attached to an access cover that is attached to the printer frame so that the access cover can open and close. More particularly, the invention relates to a printer with a cutter that assures safety when opening and closing the cover to which the movable knife is attached.

2. Related Art

Roll paper printers with a paper cutting mechanism convey the web of recording paper pulled from a paper roll through a paper feed path from the roll paper compartment passed the printing position and cutting position to the recording paper exit. A print head prints on the recording paper at the printing position, and an automatic cutter cuts the recording paper at the cutting position. The automatic cutter has a fixed knife and a movable knife pair disposed to the cutting position with the cutting edges facing the paper feed path. The movable knife can move between a standby position where there is a specific gap open between its cutting edge and the fixed knife, and an end-of-cutting position where the entire cutting edge overlaps the body of the fixed knife.

Japanese Unexamined Patent Appl. Pub. JP-A-2001-121764 teaches this type of roll paper printer with a paper cutter. In the roll paper printer with a cutter taught in JP-A-2001-121764, the fixed knife is disposed to the printer frame in which the roll paper compartment is formed, and the movable knife is attached to the access cover that opens and closes to the printer case to open and close the roll paper compartment. The movable knife is in the cutting position when the cover is in the closed position and the roll paper compartment is closed, and is moved from the cutting standby position toward the end-of-cutting position when cutting the recording paper.

With the printer taught in JP-A-2001-121764 there is no interference between the movable knife and the fixed knife when the cover opens because the movable knife is disposed to the open side of the cover relative to the fixed knife. As a result, the cover can be opened even if the automatic cutter fails while cutting the paper and the movable knife stops at the end-of-cutting position after moving from the cutting standby position.

When the cover opens when the movable knife has moved from the cutting standby position to the end-of-cutting position side, the movable knife moves with the cover while protruding from the cover, and is thus exposed outside the printer. It is therefore possible for the operator to be cut by the cutting edge of the movable knife while opening the access cover.

SUMMARY

A printer with a paper cutter according to the present invention can ensure operator safety when opening the cover to which the movable knife is attached.

A first aspect of the invention is a printer with paper cutter, including an access cover that is attached to open and close to a printer case; a recording paper cutting device that has a fixed knife disposed to the printer case and a movable knife disposed to the access cover, the movable knife positioned on the open side of the access cover relative to the fixed knife; and an engaging member that is attached to the printer case at a position closer to the open side of the access cover than the movable knife. The engaging member does not interfere with the movable knife if the access cover is opened when the movable knife pulled to the access cover, and interferes with the movable knife if the access cover is opened when the movable knife protrudes from the access cover.

When the access cover opens while the movable knife protrudes from the cover in this aspect of the invention, the movable knife disposed to the cover and the engaging member disposed on the printer case side interfere and limit movement of the cover. More specifically, the access cover cannot be opened when the movable knife is protruding from the cover. Therefore, if the automatic cutter fails while cutting the recording paper, for example, and the movable knife is effectively locked in a position between the cutting standby position and the end-of-cutting position, the operator cannot open the cover because the movable knife is protruding from the cover. As a result, because the movable knife protruding from the access cover will not move with the cover and be exposed outside the printer case, the operator that is opening the access cover will not touch the cutting edge of the movable knife. Safety can therefore be assured when opening and closing the access cover.

In a printer with a paper cutter according to another aspect of the invention, the engaging member preferably has a recording paper guide unit that guides recording paper conveyed between the fixed knife and the movable knife. This aspect of the invention guides the recording paper by means of the engaging member, and can therefore reduce the number of parts in the printer with paper cutter.

When roll paper is used as the recording paper, a printer with a paper cutter according to another aspect of the invention preferably also has a roll paper storage unit that stores roll paper, and the access cover is an access cover for opening and closing the roll paper storage unit.

A printer with paper cutter according to another aspect of the invention has an access cover that is attached to open and close to a printer case; a print head, a fixed knife, and a recording paper guide member disposed to the printer case; and a platen and movable knife disposed to the access cover. The print head and the platen are disposed opposite the printing position portion of the recording paper feed path, the fixed knife and the movable knife are disposed in opposition at a cutting position portion of the recording paper feed path where the movable knife is positioned on the open side of the access cover relative to the fixed knife, and the fixed knife can be displaced to a standby position where the cutting edge faces the cutting edge of the movable knife, and a retracted position where the cutting edge faces the recording paper guide member.

This aspect of the invention can assure safety when the operator opens the access cover and replaces the roll paper because the fixed knife can be displaced to a retracted position where the cutting edge is facing the recording paper guide member.

Further preferably in a printer with paper cutter according to another aspect of the invention, the fixed knife and the movable knife render a recording paper cutting device; the recording paper cutting device includes a movable knife drive mechanism that drives the movable knife, a top frame, and a bottom frame; the platen is disposed to the access cover through an intervening platen frame; the movable knife and the movable knife drive mechanism are disposed to the platen frame through the bottom frame; and the fixed knife and the recording paper guide member are disposed to the printer case through the top frame.

Further preferably in a printer with paper cutter according to another aspect of the invention, the fixed knife is urged to the retracted position; protruding parts are formed on both ends of the cutting edge of the movable knife widthwise to the printer; contact parts that contact the protruding parts of the movable knife are formed on both ends of the cutting edge of the fixed knife widthwise to the printer; and when the access cover is closed, the protruding parts of the movable knife and the contact parts of the fixed knife touch, and the fixed knife is positioned to the standby position.

Further preferably in a printer with paper cutter according to another aspect of the invention, the recording paper guide member is rendered by a guide plate part of which the bottom surface is positioned lower than the cutting edge of the fixed knife, a sloped part of which the bottom surface is positioned lower than the cutting edge of the fixed knife and an end part is proximal to the front surface of the movable knife, and a mounting panel part that is attached to the top frame; and the cutting edge of the fixed knife is proximal to the sloped part when in the retracted position.

Another aspect of the invention is a method of controlling a printer with paper cutter that records images including pictures or text on recording paper by a print head, conveys the recording paper by a paper feed unit, and cuts the recording paper on which an image was recorded by the print head by a recording paper cutting device including a fixed knife and a movable knife, the control method including steps of: a pair of protruding parts formed on the ends of the cutting edge of the movable knife widthwise to the printer contacting a pair of contact parts that are formed on the ends of the cutting edge of the fixed knife widthwise to the printer; displacing the fixed knife from a retracted position to a standby position; and the movable knife moving from a cutting start position where the cutting edge of the movable knife partially overlaps the cutting edge of the fixed knife toward an end-of-cutting position where the cutting edge of the movable knife completely overlaps the cutting edge of the fixed knife.

This aspect of the invention can easily control displacement of the fixed knife to a standby position where the cutting edge opposes the cutting edge of the movable knife, and a retracted position where the cutting edge opposes the recording paper guide member.

In the method of controlling a printer with paper cutter according to another aspect of the invention, the movable knife is disposed to an access cover attached to the printer case; the fixed knife is disposed to the printer case. When the access cover is closed, the pair of protruding parts formed on the ends of the cutting edge of the movable knife widthwise to the printer contact the pair of contact parts that are formed on the ends of the cutting edge of the fixed knife widthwise to the printer, and displace the fixed knife from the retracted position to the standby position.

In the method of controlling a printer with paper cutter according to another aspect of the invention, opening the access cover separates the protruding parts of the movable knife and the contact parts of the fixed knife, and displaces the fixed knife from the standby position to the retracted position.

Effect of the Invention

When the access cover opens while the movable knife protrudes from the cover in this aspect of the invention, the movable knife disposed to the cover and the engaging member disposed on the printer case side interfere and limit movement of the cover. More specifically, the access cover cannot be opened when the movable knife is protruding from the cover. As a result, because the movable knife protruding from the access cover will not move with the cover and be exposed outside the printer case, safety can be assured when opening and closing the access cover. In addition; because the cover can be opened when the fixed knife is displaced to the retracted position where the cutting edge is opposite the recording paper guide member, safety can be assured when the operator opens the access cover and replaces the roll paper.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a roll paper printer with a paper cutter according to the present invention is described below with reference to the accompanying figures.

General Configuration

Figure 1A:
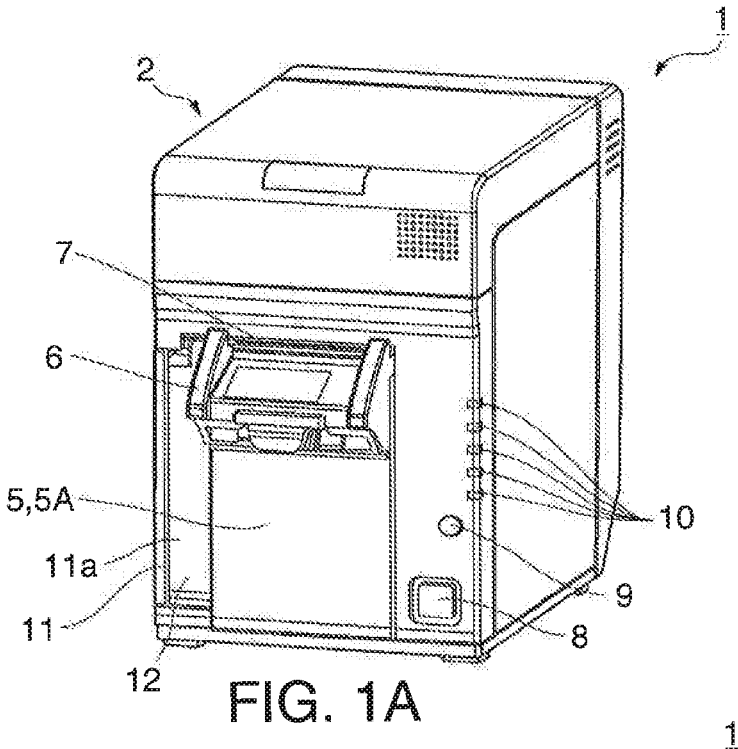
FIGS. 1A and 1B show oblique views of a roll paper printer with a paper cutter according to the invention.
Figure 1B:
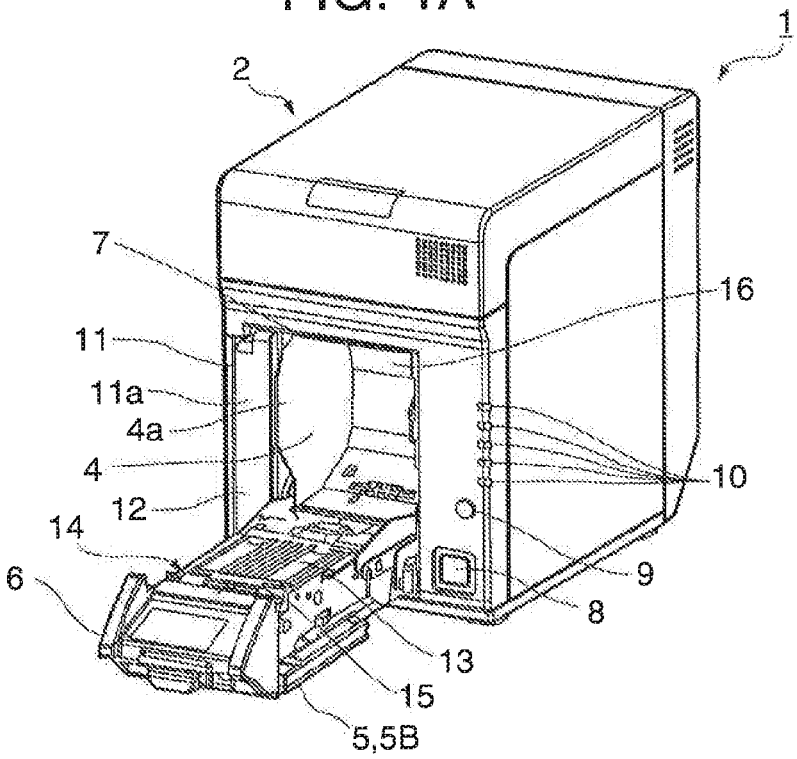

FIGS. 1A and 1B show external oblique views of a roll paper printer with a paper cutter according to a preferred embodiment of the invention. FIG. 1A shows the printer when the roll paper compartment cover is closed, and FIG. 1B shows the printer when the cover is open. The roll paper printer with cutter 1 is an inkjet printer that prints in color on a continuous web of recording paper pulled from a paper roll, and as shown in FIG. 1A has a rectangular box-shaped printer case 2.

An opening 4*a* to the roll paper compartment 4 in which the roll paper 3 is stored (see FIG. 2) is formed in the front middle part of the printer case 2, and this opening 4*a* is closed by a access cover 5 that is attached to the printer case 2 so that the access cover 5 can open and close. A recording paper exit guide 6 is attached to the top end of the access cover 5, and a paper exit 7 is formed between the recording paper exit guide 6 and the top edge part of the opening 4*a* in the printer case 2. A power switch 8, paper feed switch 9, and a plurality of operating status indicators 10 are disposed to the printer case 2 on the right side of the access cover 5.

An opening 11*a* to the ink cartridge loading unit 11 in which an ink cartridge is loaded is rendered in the printer case 2 on the left side of the access cover 5, and an ink cartridge 12 is loaded from this opening into the ink cartridge loading unit 11.

When a lock not shown is released and the recording paper exit guide 6 of the access cover 5 is manually pulled forward, the access cover 5 pivots forward on the bottom end from the closed position 5A shown in FIG. 1A to the open position 5B shown in FIG. 1B. As the access cover 5 opens from the closed position 5A, the platen 13 and the movable knife 15 of the automatic cutter 14 move with the access cover 5 to the front of the printer case 2. As a result, the paper feed path 16 from the roll paper compartment 4 to the paper exit 7 also opens, and the roll paper 3 can be easily loaded from the front of the printer.

Internal Configuration

Figure 2:
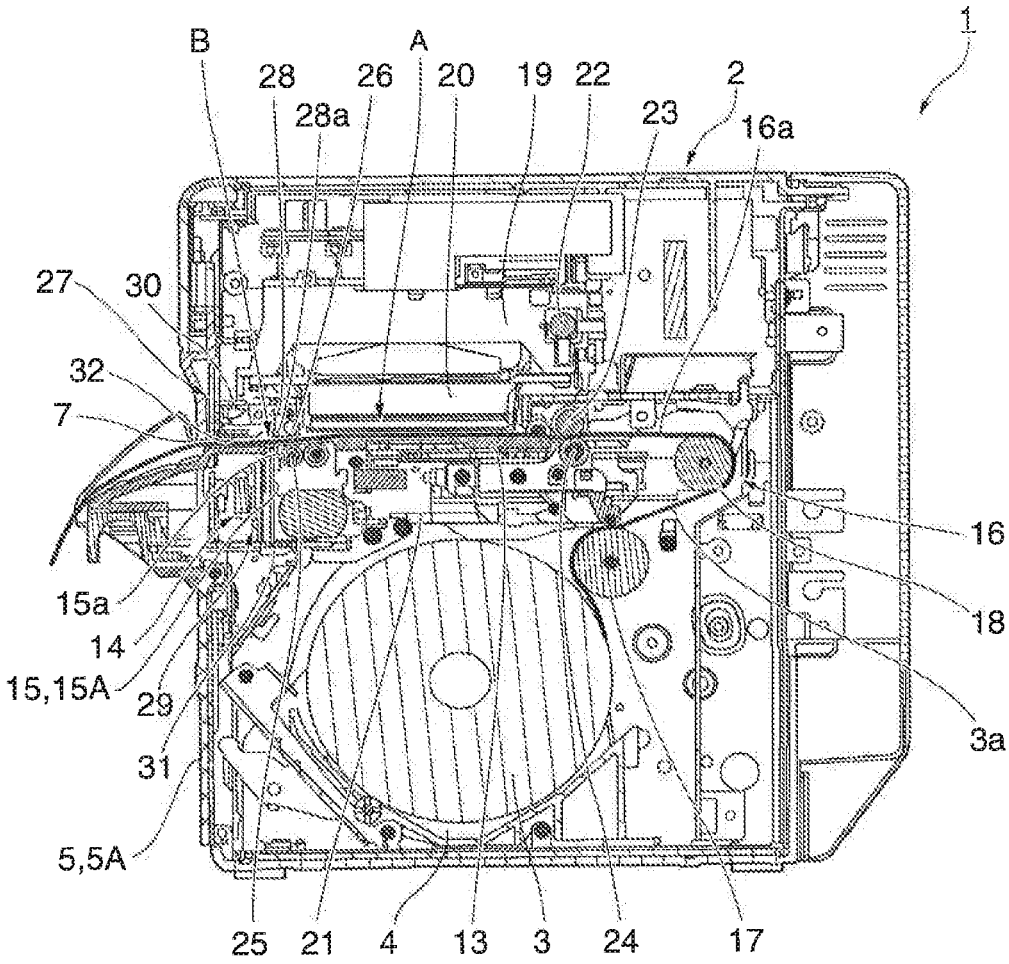
FIG. 2 is section view of the roll paper printer with a paper cutter.

FIG. 2 is a section view of the printer showing roll paper 3 loaded in the roll paper compartment 4 and the access cover 5 in the closed position. As shown in FIG. 2, a roll paper compartment 4 is formed in the middle inside the printer case 2. The roll paper 3 is loaded in the roll paper compartment 4 with the axis of rotation extending horizontally widthwise to the printer. The continuous web of recording paper 3*a* is pulled from the roll paper 3 by a feed roller 17, travels diagonally upward towards the back of the printer and curves around a tension roller 18 towards the printer front, and is conveyed along the paper feed path 16 extending in the front-back direction of the printer to the paper exit 7. The tension roller 18 is urged toward the back of the printer by the force of a spring, and the recording paper 3*a* is desirably tensioned as it passes the tension roller 18.

Paper feed path portion 16*a* extending in the front-back direction of the printer is positioned directly above the roll paper compartment 4. The printing position A and then the cutting position B are disposed in this order to the paper feed path portion 16*a* from the back of the printer to the front of the printer. The platen 13 and an inkjet head 20 mounted on a carriage 19 with the nozzle surface facing down are disposed in mutual opposition with a specific gap therebetween at the printing position A. The platen 13 is mounted on a platen frame 21 that extends in the front-back direction of the printer. The printing position A of the inkjet head 20 is determined by the platen 13. The tension roller 18 is attached at the back end part of the platen frame 21. The carriage 19 can move along a carriage guide shaft 22 that extends widthwise to the printer, and is driven bidirectionally by a carriage motor not shown.

A paper feed drive roller 23 is disposed to the paper feed path portion 16*a* to the back side of the printer behind the platen 13. A paper feed follower roller 24 is pushed from below to the paper feed drive roller 23.

A paper discharge drive roller 25 is disposed in front of the platen 13 at the front side of the printer between printing position A and cutting position B. A paper discharge follower roller 26 is pressed from above to the paper discharge drive roller 25.

The paper feed drive roller 23 and the paper discharge follower roller 26 are disposed to the printer case 2. The paper feed follower roller 24 and the paper discharge drive roller 25 are disposed to the platen frame 21.

An automatic cutter unit (recording paper cutting device) 27 is disposed to the cutting position B. The automatic cutter unit 27 includes a fixed knife 28 and a movable knife 15 pair, an automatic cutter 14 that has a movable knife drive mechanism 29 that drives the movable knife 15 to and away from the fixed knife 28, and a top frame 30 and bottom frame 31 that are disposed with the paper feed path portion 16*a* therebetween.

The top frame 30 extends widthwise to the printer at the front end part of the printer case 2, and the fixed knife 28 is attached to the top frame 30 with the cutting edge extending widthwise to the printer. The cutting edge 28*a* of the fixed knife 28 faces the paper feed path 16. The bottom frame 31 is disposed at the front end part of the platen frame 21, and the movable knife 15 is mounted on the bottom frame 31 with the cutting edge extending widthwise to the printer. The movable knife 15 is located in front of the fixed knife 28 (the side to which the access cover 5 opens), and the cutting edge 15*a* of the movable knife 15 faces the paper feed path 16.

A recording paper guide member (engaging member) 32 extending widthwise to the printer is disposed at a position near the movable knife 15 towards the front of the printer (the open side of the access cover 5). The recording paper guide member 32 is attached to the printer case 2 by means of the top frame 30.

The front part of the platen frame 21 is connected to the recording paper exit guide 6 and the platen frame 21 is thereby attached to the cover. As a result, when the access cover 5 moves from the closed position 5A to the open position 5B, the platen frame 21 moves with the access cover 5 and is pulled from the printer case 2 to the front of the printer. When the access cover 5 opens, the platen 13, movable knife 15, movable knife drive mechanism 29, tension roller 18, paper feed follower roller 24, paper discharge drive roller 25, and other parts carried on the platen frame 21 move with the access cover 5 to the front of the printer, and the roll paper compartment 4 and the paper feed path 16 are thus opened.

When roll paper 3 is loaded into the roll paper compartment 4, the roll paper 3 is dropped into the roll paper compartment 4 through the open space rendered by opening the access cover 5 with a leader of recording paper 3*a* pulled out to the front of the printer. When the access cover 5 is then closed, the platen 13, movable knife 15, movable knife drive mechanism 29, tension roller 18, paper feed follower roller 24, paper discharge drive roller 25, and other parts carried on the platen frame 21 return to their original positions and the paper feed path 16 is formed. The platen 13 returns to the printing position A with a specific gap to the inkjet head 20. The movable knife 15 returns to the cutting position B. The leader of recording paper 3*a* is set in the paper feed path 16 passed the printing position A of the platen 13 and the cutting position B.

The recording paper 3*a* pulled from the roll paper compartment 4 through the paper feed path 16 is conveyed between the paper feed drive roller 23 and paper feed follower roller 24 passed the printing position A. The surface of the recording paper 3*a* is printed on by the inkjet head 20 at the printing position A. The recording paper 3*a* is then conveyed between the paper discharge drive roller 25 and paper discharge follower roller 26 passed the cutting position B, and is cut across the paper width by the automatic cutter 14 at the cutting position B. The portion of the recording paper that is thus printed and cut to a certain length is then issued as a sales receipt, for example.

Automatic Cutter Unit and Recording Paper Guide Member

Figure 3A:
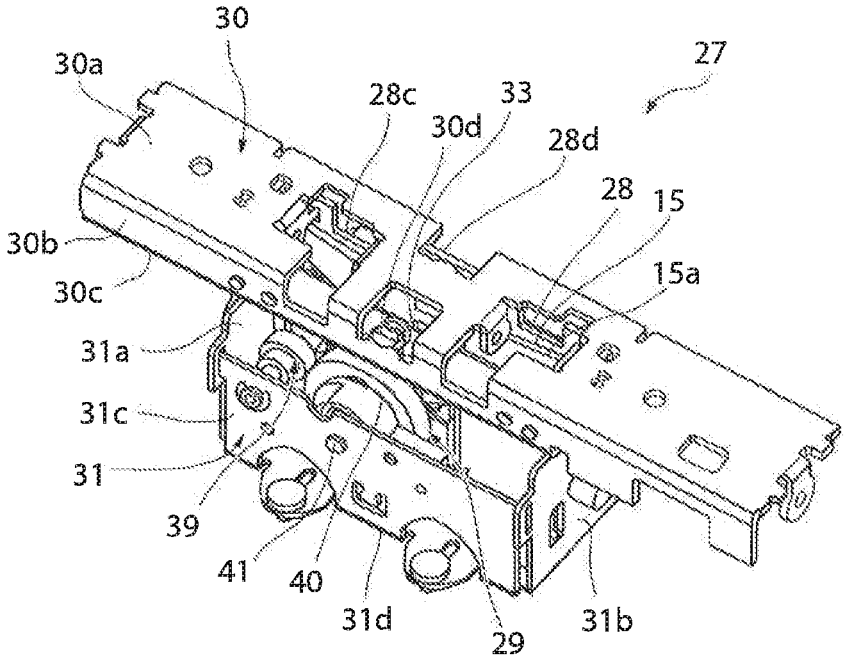
FIGS. 3A and 3B show oblique views of the automatic paper cutter.
Figure 3B:
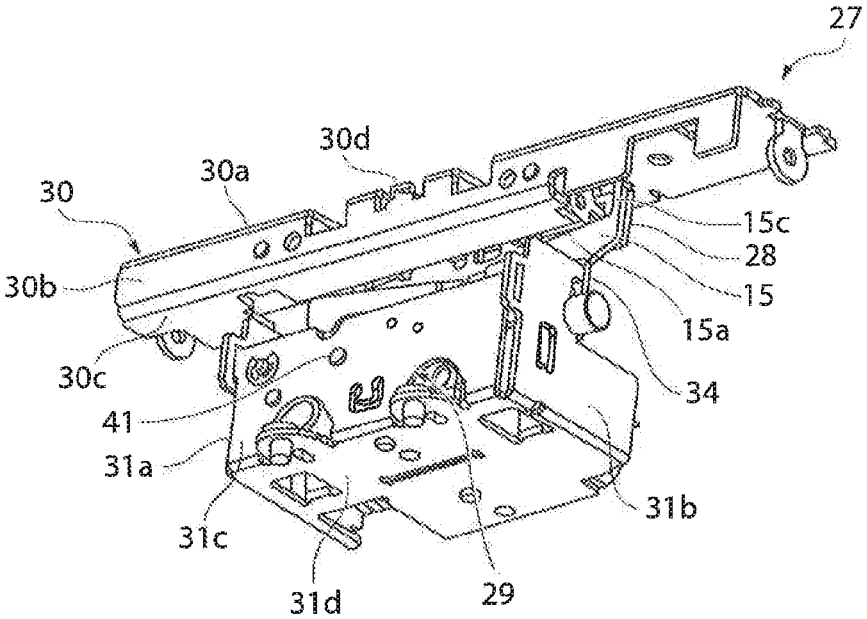

FIG. 3A is an oblique view of the automatic cutter unit as seen from diagonally above the front, and FIG. 3B is an oblique view of the automatic cutter unit as seen from diagonally below the front.

Figure 4B:
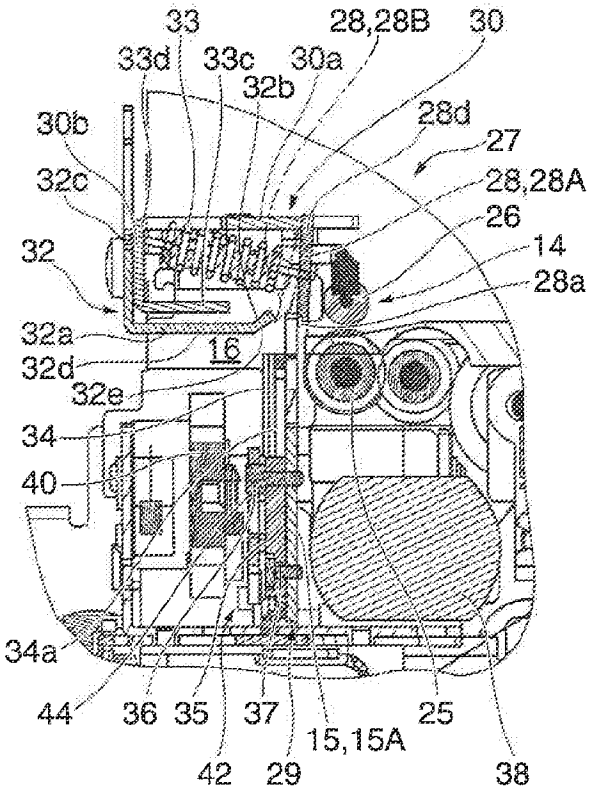
FIGS. 4A and 4B show a front view and a section view of the paper guide member and the automatic paper cutter.
Figure 4A:
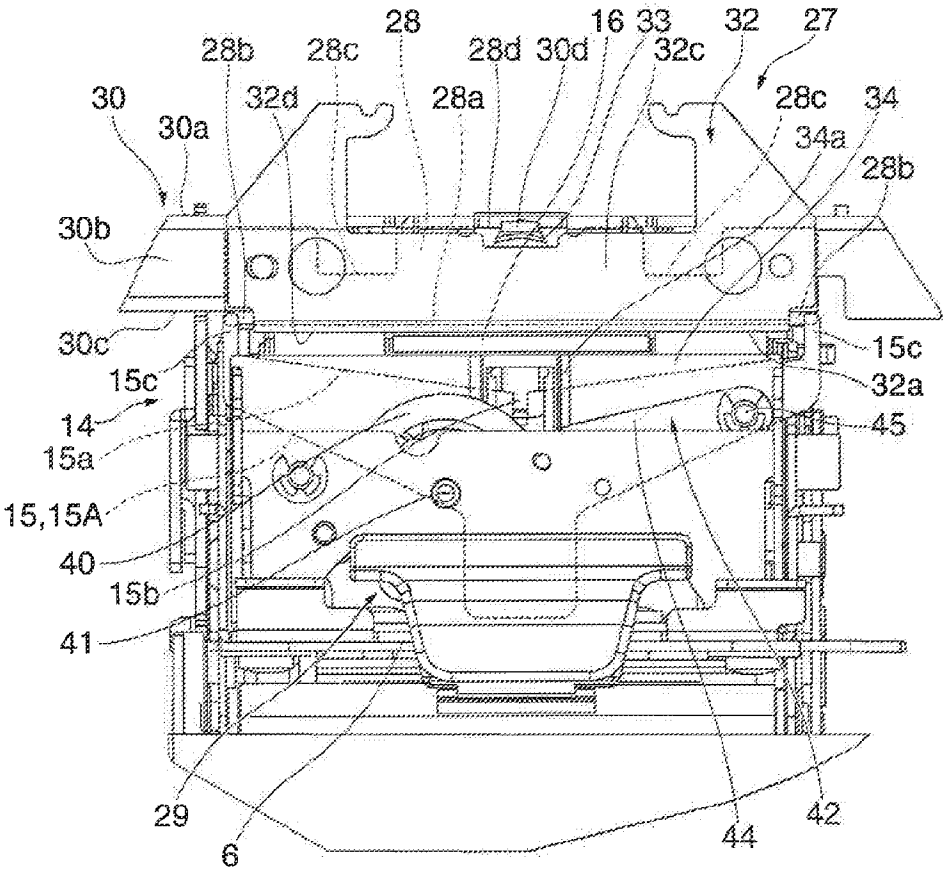

FIG. 4A is a partial front view and FIG. 4B is a section view of the automatic cutter unit when the recording paper guide member 32 is attached. FIGS. 4A and 4B show the movable knife 15 in the cutting standby position.

Figure 5A:
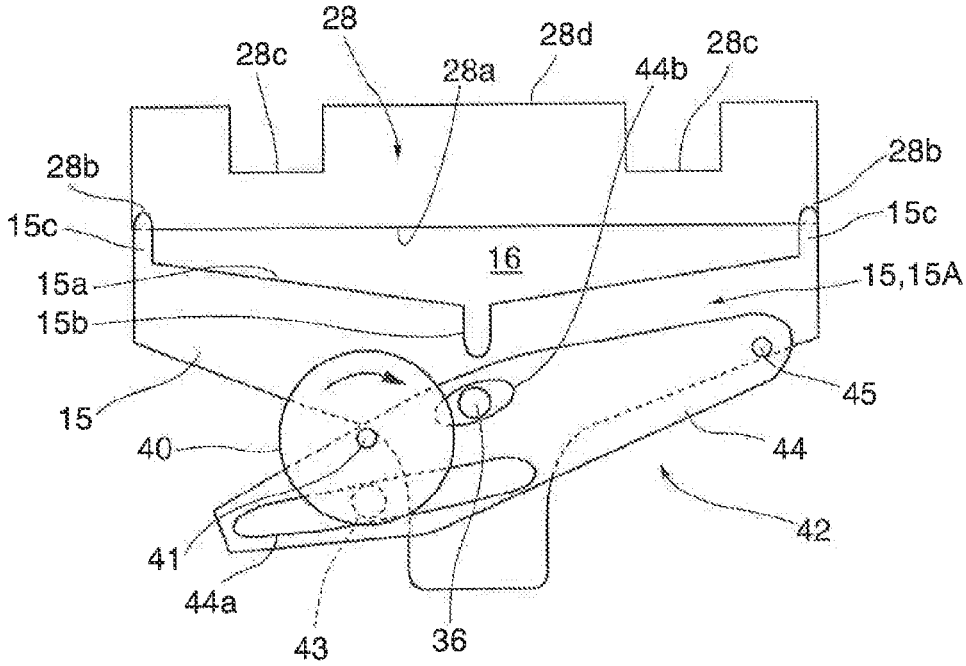
FIGS. 5A and 5B describe the movable knife drive mechanism.
Figure 5B:
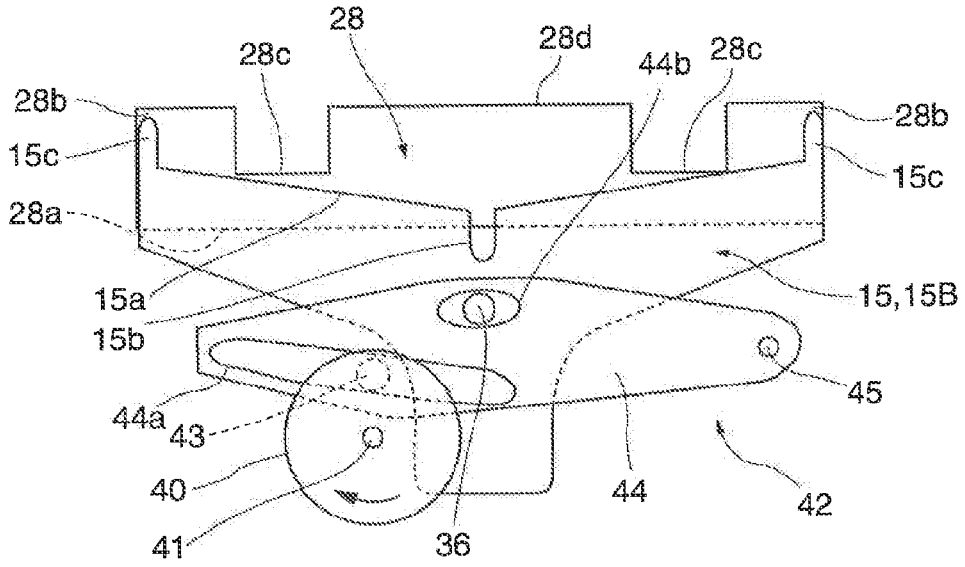

FIGS. 5A and 5B describe the movable knife drive mechanism 29, FIG. 5A showing the movable knife 15 in the cutting standby position, and FIG. 5B showing the movable knife 15 in the end-of-cutting position.

As shown in FIGS. 3A and 3B and FIGS. 4A and 4B, the top frame 30 of the automatic cutter unit 27 includes a top panel part 30*a* that extends in the front-back direction of the printer, a front panel part 30*b* that extends down from the front edge of the top panel part 30*a*, and a bottom panel part 30*c* that extends toward the back of the printer from the bottom edge of the front panel part 30*b*.

As shown in FIGS. 4A and 4B, the fixed knife 28 is rectangular with the long side extending widthwise to the printer. The cutting edge 28*a* is formed extending in a straight line at the bottom edge of the fixed knife 28. A pair of stops 28*b* that contact protrusions of the movable knife 15 described below are formed at the opposite ends of the cutting edge 28*a* widthwise to the printer. These stops 28*b* are positioned outside the paper feed path 16 widthwise to the printer. A pair of rectangular notches 28*c* are disposed in the top edge part of the fixed knife 28 at left and right symmetrical positions widthwise to the printer. A top edge middle part 28*d* between the pair of notches 28*c* is attached to the middle part of the top panel part 30*a* of the top frame 30 widthwise to the printer.

The fixed knife 28 attached to the top frame 30 can be displaced by rocking on the top edge middle part 28*d* between a standby position 28A where the cutting edge 28*a* faces the paper feed path 16 at the cutting position B, and a retracted position (the position shown in FIG. 4B by the dotted line) where the cutting edge 28*a* is near the recording paper guide member 32 and faces the recording paper guide member 32.

One end of a coil spring 33 is attached to the widthwise center part of the fixed knife 28. The other end of the coil spring 33 is attached to a catch 30*d* formed in the center widthwise to the printer between the corners of the top panel part 30*a* and front panel part 30*b*. The fixed knife 28 is urged toward a retracted position 28B by the coil spring 33.

As shown in FIGS. 4A and 4B, the recording paper guide member 32 is attached from the front of the printer to the front panel part 30*b* of the top frame 30.

The recording paper guide member 32 has a guide plate part 32*a* that extends in the front-back direction of the printer substantially parallel to the platen 13, a sloped part 32*b* that that slopes upward towards the back of the printer from the back edge of the guide plate part 32*a*, and a mounting panel part 32*c* that extends upward from the front edge of the guide plate part 32*a*. The back end of the sloped part 32*b* is positioned slightly closer to the front of the printer than the movable knife 15. When the fixed knife 28 is at the retracted position 28B, the cutting edge 28*a* of the fixed knife 28 is near the sloped part 32*b* and faces the sloped part 32*b*.

The bottom surface 32*d* of the guide plate part 32*a* and the downward-facing sloped surface 32*e* of the sloped part 32*b* render guide surfaces that guide the surface of the recording paper 3*a* (the surface on the side toward the fixed knife 28) that passed the cutting position B along the paper feed path 16. The bottom surface 32*d* is positioned below the cutting edge 28*a* of the fixed knife 28. In addition, the bottom surface 32*d* is positioned below the bottom surface of the paper discharge follower roller 26. As a result, if the leading end of the recording paper 3*a* discharged from the paper exit 7 is pulled up by the operator before being cut, force causing the paper discharge follower roller to move up can be prevented from being applied to the paper discharge follower roller 26.

The size of the bottom edge part of the mounting panel part 32*c*, the guide plate part 32*a*, and the sloped part 32*b* of the recording paper guide member 32 widthwise to the printer is smaller than the size of the fixed knife 28 widthwise to the printer. When the recording paper guide member 32 is attached to the top frame 30, the recording paper guide member 32 covers the cutting edge 28*a* of the fixed knife 28 from the front of the printer, and the pair of stops 28*b* disposed to the opposite ends of the cutting edge 28*a* are exposed at the printer front.

As shown in FIGS. 3A and 3B and FIGS. 4A and 4B, the bottom frame 31 of the automatic cutter unit 27 has left and right side panels 31*a* and 31*b*, a front panel 31*c* that spans the front ends of the left and right side panels 31*a* and 31*b*, and a bottom panel 31*d* that spans the bottom ends of the left and right side panels 31*a* and 31*b*. A divider 34 extends parallel to the front panel 31*c* in the middle of the left and right side panels 31*a* and 31*b* in the front-back direction of the printer.

The movable knife 15 is on the back side of the divider 34. As shown in FIG. 5, the center of the cutting edge of the movable knife 15 widthwise to the printer is recessed and lower than the distal ends, and the cutting edge slopes upward from this center portion to the distal ends of the movable knife 15. A channel-like notch 15*b* is formed in the middle of the cutting edge 15*a*. A pair of protruding parts 15*c* that project upward is formed on the opposite ends of the cutting edge 15*a* widthwise to the printer. The pair of protruding parts 15*c* are positioned widthwise to the printer outside of the paper feed path 16.

The divider 34 has a guide channel 34*a* that extends vertically in the middle widthwise to the printer. A slider 35 is inserted to the guide channel 34*a* so that the slider 35 can move vertically along the guide channel 34*a*. The slider 35 is attached to the movable knife 15 by two pins 36 and 37 disposed one above the other. As a result, the movable knife 15 can move vertically with the slider 35 along the guide channel 34*a*.

The movable knife drive mechanism 29 has a cutter motor 38 that is disposed with the output shaft extending widthwise to the printer behind the divider 34. The output shaft of the cutter motor 38 is connected to a drive gear 40, which is disposed in front of the divider 34, through a gear train 39 that includes a worm gear. The drive gear 40 can rotate freely on a support shaft 41 attached to the front panel 31*c*. The rotational movement of the drive gear 40 is converted by a crank mechanism 42 to the vertical bidirectional movement of the movable knife 15.

As shown in FIGS. 5A and 5B, the crank mechanism 42 includes a crank pin 43 that protrudes perpendicularly to the round end face of the drive gear 40 at a position offset from the axis of rotation, and a lever 44 in which a straight first slide channel 44*a* of a specific length is formed.

The lever 44 is in front of the divider 34, and can pivot vertically along the front surface of the divider 34 on a support pin 45 that is independent of the support shaft 41 of the drive gear 40. The crank pin 43 is slidably inserted to the first slide channel 44*a*. When the crank pin 43 turns one revolution around the support shaft 41 in conjunction with rotation of the drive gear 40, the lever 44 pivots once up and down on the support pin 45 following the movement of the crank pin 43 vertically and widthwise to the printer.

A second slide channel 44*b* that is shorter in length than the first slide channel 44*a* is formed in the lever 44. Of the two pins 36 and 37 connecting the movable knife 15 and the slider 35, the upper pin 36 is slidably inserted to the second slide channel 44*b*. When the second slide channel 44*b* moves vertically up and down in conjunction with the bidirectional up-down pivoting action of the lever 44, the upper pin 36 also moves bidirectionally up and down following the bidirectional movement of the second slide channel 44*b*.

As a result, the movable knife 15 moves once up and down between the cutting standby position 15A where the cutting edge 15*a* opposes the cutting edge 28*a* of the fixed knife 28 with a specific gap therebetween as shown in FIG. 5A, and the end-of-cutting position 15B where the entire length of the cutting edge 15*a* overlaps the cutting edge 28*a* of the fixed knife 28 as shown in FIG. 5B.

Recording Paper Cutting Operation

The operation whereby the automatic cutter 14 cuts the recording paper 3*a* is described next with reference to FIGS. 4A and 4B to FIG. 8.

Figure 6B:
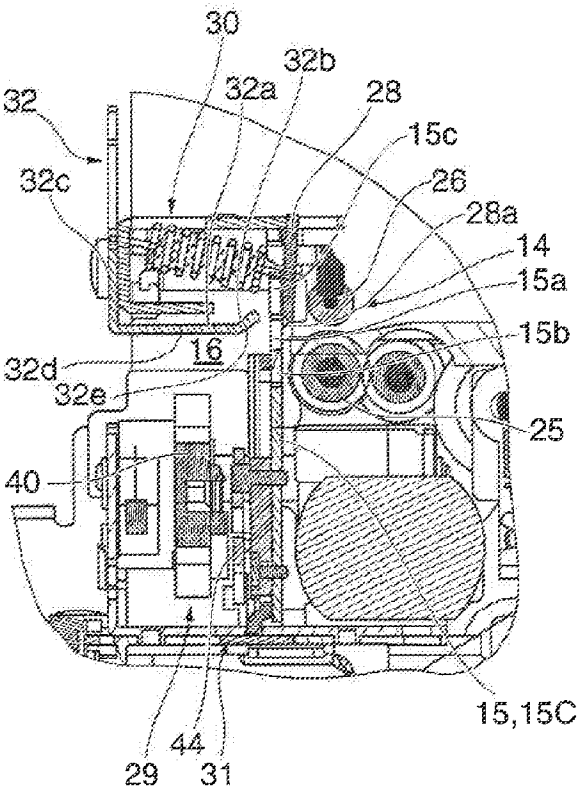
FIGS. 6A and 6B show a front view and a section view of the paper guide member and the automatic paper cutter.
Figure 6A:
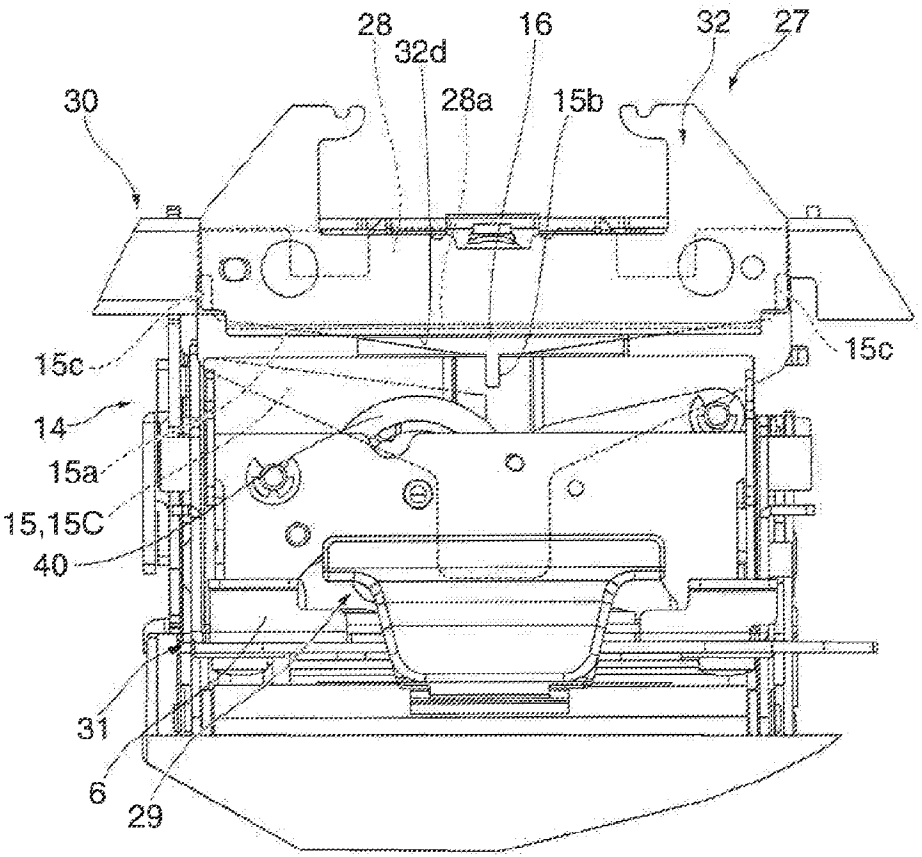

FIG. 6A is a partial front view and FIG. 6B is a section view of the automatic cutter unit when the recording paper guide member is attached. FIGS. 6A and 6B show the movable knife in the cutting start position.

Figure 7B:
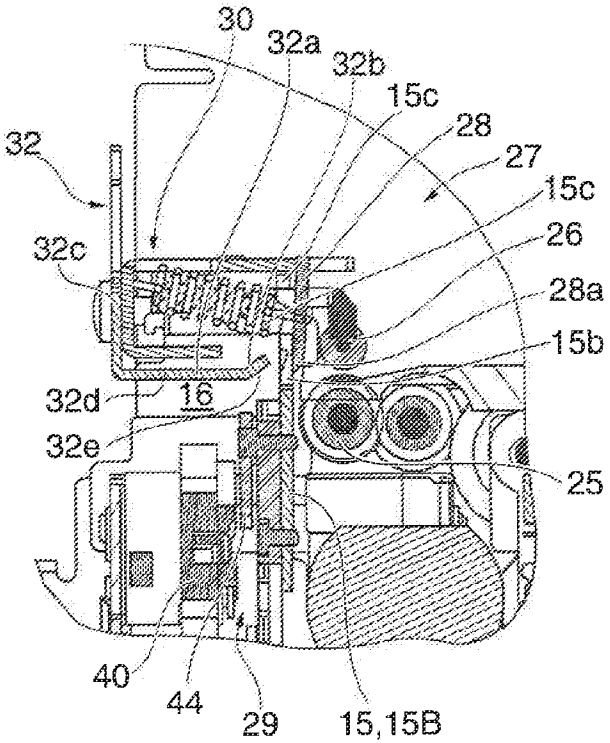
FIGS. 7A and 7B show a front view and a section view of the paper guide member and the automatic paper cutter.
Figure 7A:
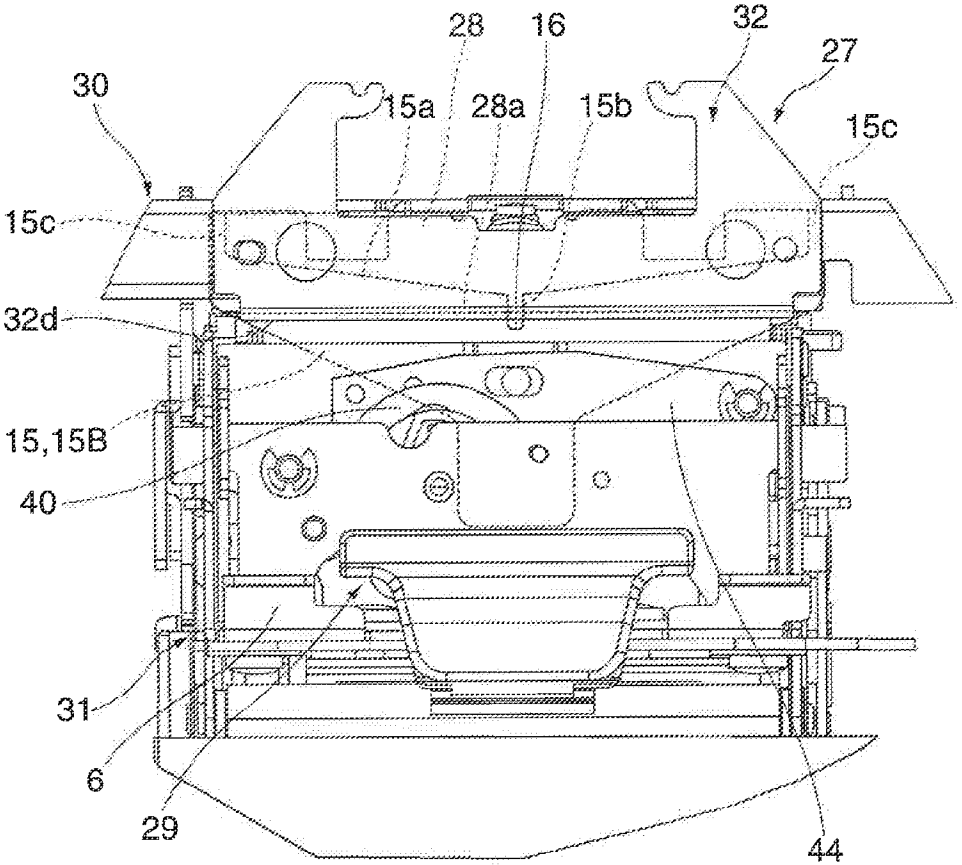

FIG. 7A is a partial front view and FIG. 7B is a section view of the automatic cutter unit when the recording paper guide member is attached. FIGS. 7A and 7B show the movable knife in the end-of-cutting position.

Figure 8:
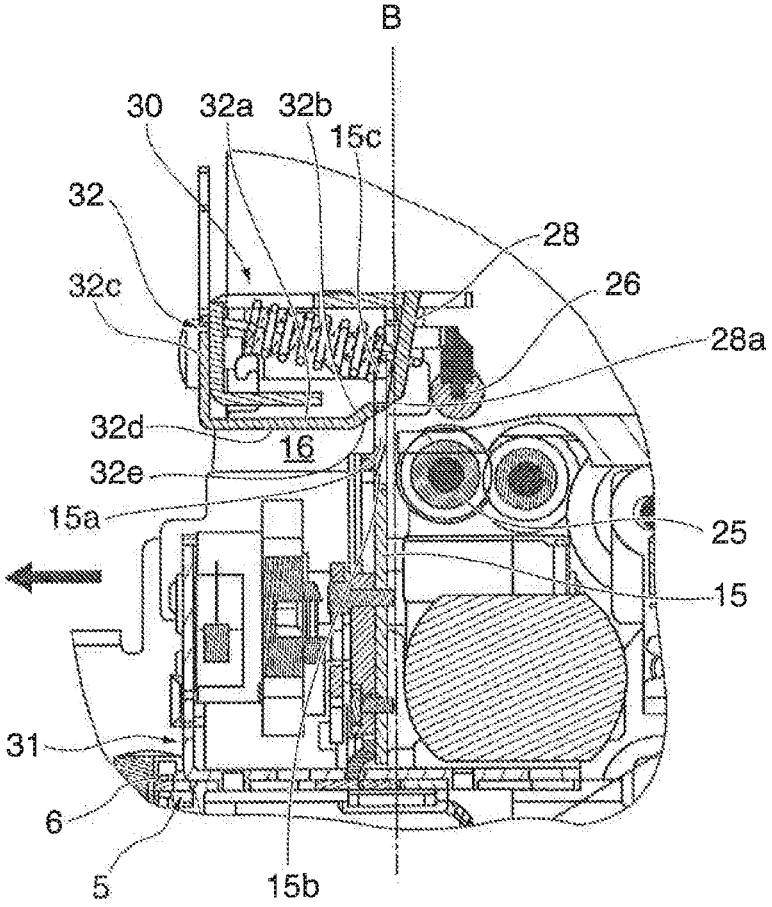
FIG. 8 is a vertical section view of the area proximal to the cutting position when the cover opens.

FIG. 8 is a vertical section view of the area near the cutting position, and shows when the access cover is opened from the closed position while the movable knife is in the printing start position.

Note that in FIGS. 4A and 4B to FIG. 8 the recording paper that is conveyed so that it passes the cutting position is not shown.

Closing the access cover 5 after dropping roll paper 3 into the roll paper compartment 4 causes the access cover 5 to move toward the closed position 5A, the pair of protruding parts 15*c* at the opposite ends of the cutting edge 15*a* of the movable knife 15 to contact the pair of stops 28*b* at the opposite ends of the cutting edge 28*a* of the fixed knife 28 from the side at the front of the printer, and the fixed knife 28 to be displaced to the standby position 28A in resistance to the urging force of the coil spring 33. When the access cover 5 is set to the closed position 5A, the movable knife 15 is in the cutting position B.

When set to the cutting position B, the movable knife 15 is at the cutting standby position 15A. At the cutting standby position 15A, the movable knife 15 opposes the cutting edge 28*a* of the fixed knife 28 with a specific gap therebetween, and is retracted to a position below the paper feed path 16 (is pulled into the access cover 5).

When the recording paper 3*a* printed at the printing position A is then conveyed to the cutting position B, the movable knife 15 is moved by the movable knife drive mechanism 29 from the cutting standby position 15A to the end-of-cutting position 15B. As shown in FIGS. 6A and 6B, when the movable knife 15 moves and the cutting edge 15*a* thereof reaches the cutting start position 15C partially overlapping the cutting edge 28*a* of the fixed knife 28 from both sides widthwise to the printer, the automatic cutter 14 starts cutting the recording paper 3*a* at the cutting position B from both sides. The movable knife 15 protrudes into the paper feed path 16 (protrudes from the access cover 5) at the cutting start position 15C.

When the movable knife 15 then moves to the end-of-cutting position 15B, the cutting edge 15*a* of the movable knife 15 and the cutting edge 28*a* of the fixed knife 28 completely overlap each other and cutting the recording paper 3*a* is completed.

Because a notch 15*b* is formed in the center of the cutting edge 15*a* of the movable knife 15 in this embodiment of the invention, the recording paper 3*a* is partially cut, leaving an uncut portion in the middle of the paper width instead of being cut completely across the width, even though the cutting edge 15*a* of the movable knife 15 completely overlaps the cutting edge 28*a* of the fixed knife 28. When cutting the recording paper 3*a* is thus finished, the movable knife 15 returns to the cutting standby position 15A.

When the movable knife 15 moves from the cutting start position 15C to the end-of-cutting position 15B side, the part of the cutting edge 15*a* of the movable knife 15 overlapping the cutting edge 28*a* of the fixed knife 28 is at a position higher than the bottom surface 32*d* of the recording paper guide member 32. Therefore, if the automatic cutter 14 fails while the recording paper 3*a* is being cut and the access cover 5 is opened from the closed position 5A while the movable knife 15 is locked in a position where it protrudes more to the end-of-cutting position 15B than when in the cutting start position 15C, movement of the access cover 5 is restricted by interference of the sloped part 32*b* of the recording paper guide member 32 with the movable knife 15 protruding into the paper feed path 16 when the movable knife 15 moves with the access cover 5 from the cutting position B to the front of the printer as shown in FIG. 8.

As a result, because the access cover 5 cannot be opened, the movable knife 15 protruding from the access cover 5 to the fixed knife 28 side does not move with the access cover 5 to a position exposed to the outside of the printer case 2, and the operator that is opening the access cover 5 will not touch the cutting edge 15*a* of the movable knife 15. Safety is therefore assured when opening and closing the access cover 5.

Note that because the movable knife 15 retracts from the paper feed path 16 when the movable knife 15 returns to the cutting standby position 15A after the recording paper cutting operation ends, the movable knife 15 and the recording paper guide member 32 do not interfere. The access cover 5 can therefore be opened to the open position 5B.

Other Embodiments

The recording paper guide member 32 and movable knife 15 interfere with opening the access cover 5 when the movable knife 15 moves closer to the end-of-cutting position 15B side than the cutting start position 15C in the embodiment described above, but a configuration in which the recording paper guide member 32 and movable knife 15 interfere when the access cover 5 is opened with the movable knife 15 at the end-of-cutting position 15B is also conceivable. In this configuration the position where the recording paper guide member 32 is attached to the top frame 30 is moved up, and the positions of the guide plate part 32*a* and the sloped part 32*b* are moved up.

A configuration in which the recording paper guide member 32 and movable knife 15 interfere when the access cover 5 is opened after the movable knife 15 moves slightly from the cutting standby position 15A to the end-of-cutting position 15B side and the cutting edge 15*a* of the movable knife 15 protrudes into the paper feed path 16 (the cutting edge 15*a* is positioned to the cutting standby position 15A of the cutting start position 15C) is also conceivable. In this configuration the position where the recording paper guide member 32 is attached to the top frame 30 is moved down, and the positions of the guide plate part 32*a* and sloped part 32*b* are moved down.

Movement of the access cover 5 is limited by making the recording paper guide member 32 and the movable knife 15 interfere when the access cover 5 is opened in the embodiment described above, but a configuration in which an engaging member separate from the recording paper guide member 32 is attached to the printer case 2 at a position closer to the front of the printer than the movable knife 15 so that the engaging member and the movable knife 15 interfere with each other is also conceivable.

The automatic cutter 14 in the embodiment described above moves the movable knife 15 bidirectionally in a straight line to and away from the fixed knife 28, but the invention can also be applied to a scissor type automatic cutter that causes the movable knife to pivot to and away from the fixed knife if the fixed knife is disposed to the printer case side and the movable knife is disposed to an access cover that is attached to open and close to the printer case.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer with paper cutter, comprising:

an access cover that is attached to open and close to a printer case;

a print head, a fixed knife, and a recording paper guide member disposed to the printer case; and a platen and movable knife disposed to the access cover;

wherein the print head and the platen are disposed opposite a printing position portion of a recording paper feed path, the fixed knife and the movable knife are disposed in opposition at a cutting position portion of the recording paper feed path where the movable knife is positioned on an open side of the access cover relative to the fixed knife, and the fixed knife can be displaced to a standby position where a cutting edge of the fixed knife faces a cutting edge of the movable knife, and a retracted position where the cutting edge of the fixed knife faces the recording paper guide member, wherein the recording paper guide member is rendered by a guide plate part of which a bottom surface is positioned lower than the cutting edge of the fixed knife, a sloped part of which a bottom surface is positioned lower than the cutting edge of the fixed knife and an end part is proximal to a front surface of the movable knife, and a mounting panel part that is attached to the printer case, and wherein the cutting edge of the fixed knife is proximal to the sloped part when in the retracted position.

2. The printer with paper cutter described in claim 1, wherein:

the fixed knife and the movable knife render a recording paper cutting device;

the recording paper cutting device includes a movable knife drive mechanism that drives the movable knife, a top frame, and a bottom frame;

the platen is disposed to the access cover through a platen frame;

the movable knife and the movable knife drive mechanism are disposed to the platen frame through the bottom frame; and the fixed knife and the recording paper guide member are disposed to the printer case through the top frame.

3. The printer with paper cutter described in claim 1, wherein:

the fixed knife is urged to the retracted position;

protruding parts are formed on both ends of the cutting edge of the movable knife widthwise to the printer;

contact parts that contact the protruding parts of the movable knife are formed on both ends of the cutting edge of the fixed knife widthwise to the printer; and when the access cover is closed, the protruding parts of the movable knife and the contact parts of the fixed knife touch, and the fixed knife is positioned to the standby position.

4. A method of controlling a printer with a paper cutter that records images including pictures or text on recording paper by a print head, conveys the recording paper by a paper feed unit, and cuts the recording paper on which an image was recorded by the print head by a recording paper cutting device including a fixed knife disposed to a printer case and a movable knife disposed to an access cover that is attached to the printer case, the control method comprising steps of:

displacing the fixed knife from a retracted position, where a cutting edge of the fixed knife faces a recording paper guide member, to a standby position, where the cutting edge of the fixed knife faces a cutting edge of the movable knife, wherein a pair of protruding parts formed on ends of a cutting edge of the movable knife widthwise to the printer contact a pair of contact parts that are formed on ends of a cutting edge of the fixed knife widthwise to the printer, wherein the recording paper guide member is rendered by a guide plate part of which a bottom surface is positioned lower than the cutting edge of the fixed knife, a sloped part of which a bottom surface is positioned lower than the cutting edge of the fixed knife and an end part is proximal to a front surface of the movable knife, and a mounting panel part that is attached to the printer case, and wherein the cutting edge of the fixed knife is proximal to the sloped part when in the retracted position; and moving the movable knife from a cutting start position where the cutting edge of the movable knife partially overlaps the cutting edge of the fixed knife toward an end-of-cutting position where the cutting edge of the movable knife completely overlaps the cutting edge of the fixed knife.

5. The method of controlling a printer with paper cutter described in claim 4, wherein:

the fixed knife is displaced from the retracted position to the standby position when the access cover is closed.

6. The method of controlling a printer with paper cutter described in claim 4, further comprising:

opening the access cover, which separates the protruding parts of the movable knife and the contact parts of the fixed knife, and displaces the fixed knife from the standby position to the retracted position.

* * * * *